US007325799B2

(12) United States Patent
Watkiss

(10) Patent No.: US 7,325,799 B2
(45) Date of Patent: Feb. 5, 2008

(54) METHOD AND APPARATUS FOR BOOKLET PRODUCTION

(75) Inventor: Christopher Robin Watkiss, Biggleswade (GB)

(73) Assignee: Watkiss Automation Limited (GB)

( * ) Notice: Subject to any disclaimer, the term of this patent is extended or adjusted under 35 U.S.C. 154(b) by 0 days.

(21) Appl. No.: 10/851,840

(22) Filed: May 21, 2004

(65) Prior Publication Data

US 2005/0008460 A1 Jan. 13, 2005

(30) Foreign Application Priority Data

May 21, 2003 (GB) ..... 0311715.7

(51) Int. Cl.
*B42C 3/00* (2006.01)

(52) U.S. Cl. ..... 270/39.08; 270/39.06; 270/39.07; 493/444; 493/445; 493/449

(58) Field of Classification Search ..... 270/32, 270/37, 39.06, 39.07, 39.08; 493/444, 445, 493/449

See application file for complete search history.

(56) References Cited

U.S. PATENT DOCUMENTS

| | | | | |
|---|---|---|---|---|
| 2,066,620 | A | 1/1937 | Grammer | 281/15 |
| 2,068,603 | A | 1/1937 | Grammer | 281/21 |
| 2,088,904 | A | 8/1937 | Grammer | 281/15 |
| 3,085,265 | A | 4/1963 | Biel et al. | 11/1 |
| 4,243,459 | A | 1/1981 | Lawes | 156/275.1 |
| 4,875,668 | A | 10/1989 | Spyra | 270/45 |
| 5,221,112 | A | 6/1993 | Holmberg | 281/21.1 |
| 5,672,030 | A | 9/1997 | Dean | 412/7 |
| 5,871,323 | A | 2/1999 | Clark | 412/4 |
| 5,941,671 | A | 8/1999 | Wehrle | 412/8 |
| 5,961,268 | A | 10/1999 | Jager | 412/1 |

(Continued)

FOREIGN PATENT DOCUMENTS

DE 2 225 062 12/1973

(Continued)

OTHER PUBLICATIONS

GB 0017939.0 Search Report dated Oct. 16, 2000.

(Continued)

*Primary Examiner*—Douglas A Hess
(74) *Attorney, Agent, or Firm*—Woodcock Washburn LLP

(57) ABSTRACT

A stack of sheets of sheet material is stapled along an axis and fed to a position from which it is folded along the axis by a blade to form a booklet having a curved spine. The blade also inserts the booklet into a position between clamping jaws and determines its final position therebetween. Rotatable guide rollers guide the sheets into the gap and are fitted with one-way clutches to resist upward movement of the folded sheets upon retraction of the blade from the gap. In a first mode of operation, the curved spine of the booklet protrudes a short distance beyond the jaws. The spine is then flattened by a forming roller which passes along the spine. In a second mode of operation, the spinal portion lies between the jaws and the curved end surface is flattened by the clamping force alone. The first mode is suited to booklets having or more sheets; the second to booklets having fewer than sheets or having loop staples and any number of sheets.

39 Claims, 7 Drawing Sheets

U.S. PATENT DOCUMENTS

| | | | | |
|---|---|---|---|---|
| 6,047,977 | A * | 4/2000 | Brokholc | 280/93.5 |
| 6,142,721 | A | 11/2000 | Marsh | 412/1 |
| 6,168,363 | B1 | 1/2001 | Nehring | 412/30 |
| 6,199,851 | B1 | 3/2001 | Latvakangas et al. | 270/58.08 |
| 6,250,867 | B1 | 6/2001 | Gwyn et al. | 412/19 |
| 6,338,603 | B1 | 1/2002 | Cerruti | 412/1 |
| 6,817,605 | B1 * | 11/2004 | Bohn | 270/37 |
| 2002/0193227 | A1 * | 12/2002 | Uera et al. | 493/427 |

FOREIGN PATENT DOCUMENTS

| | | | |
|---|---|---|---|
| EP | 0 945 386 | A1 | 4/1980 |
| EP | 0 034 921 | | 9/1981 |
| EP | 0 107 424 | | 5/1984 |
| EP | 0 153 983 | | 9/1985 |
| EP | 0 614 841 | A1 | 9/1994 |
| EP | 0 741 097 | A2 | 11/1996 |
| EP | 0 945 384 | A1 | 9/1999 |
| EP | 1138521 | A2 * | 10/2001 |
| GB | 1121493 | | 7/1968 |
| GB | 2 031 798 | | 4/1980 |
| GB | 2 360 013 | A | 9/2001 |
| GB | 0 311 715.7 | | 5/2003 |
| JP | 2001-260564 | | 9/2001 |
| JP | 2004209886 | A * | 7/2004 |
| WO | WO 94/29117 | | 12/1994 |
| WO | WO 97/17209 | | 5/1997 |

OTHER PUBLICATIONS

GB 0311715.7 Search report dated Oct. 6, 2003.

* cited by examiner

METHOD AND APPARATUS FOR BOOKLET PRODUCTION

CROSS REFERENCE TO RELATED APPLICATIONS

This claims benefit of United Kingdom Application 0311715.7, filed May 21, 2003, which is incorporated in its entirety by reference herein.

FIELD OF THE INVENTION

This invention relates generally to methods of and apparatus for producing booklets and the like, and is also concerned with booklets and the like when produced by these methods. The term "booklet" used hereinafter is intended to cover any set of folded sheets which are stitched or stapled along an axis, which are glued, or which are simply folded. The term "booklet" is therefore intended to include items such as brochures, pamphlets, manuals and the like.

BACKGROUND OF THE INVENTION

Customarily, the folding of a set of up to perhaps 30 or so sheets in a stitcher/folder machine results in the finished product having a spine with a convex end surface and sheets having a distinct outward bow adjacent the spine. This means that the booklet tends to open out, giving it a less attractive appearance, and also makes it more difficult to stack a number of the booklets for storage and transportation purposes because they will not lie "flat". One cannot stack a large number of such booklets all with the spine on the same side, because the stack becomes lop-sided. One has to stack the booklets with some spines on one side and some on the other, in order to equalise the stack.

GB-A-2360013 describes a method of treating a booklet of sheets folded to create a curved spine, and an apparatus for carrying out the method. A folded booklet is clamped adjacent its spine between clamping jaws which extend along the length of the spine and have respective longitudinal ribs which engage the booklet adjacent the spine. The booklet is fed through the jaws into a position in which it abuts a stop plate and a portion adjacent the spine protrudes beyond the jaws. The final position is determined by the stop plate. After withdrawal of the stop plate, a forming means is passed along the length of the protruding portion to flatten the curved spine of the booklet.

Whilst perfectly satisfactory from many points of view, the apparatus and method of GB-A-2360013 is subject to the disadvantage that it can be relatively slow in operation and can be limited in the thickness of the booklets it can process.

SUMMARY OF THE INVENTION

According to the present invention, there is provided an apparatus for treating a stack of sheets of sheet material, comprising first and second clamping jaws which define a gap therebetween and are movable relative to each other to increase and decrease the gap, means for folding a stack of sheets of sheet material about an axis to form a booklet having a spinal portion, the spinal portion having a convex end surface which extends in the direction of the axis, and means for inserting the booklet into the gap into a final position determined by the inserting means, in which the spinal portion lies between the jaws or protrudes therefrom by a predetermined distance in the direction of insertion, and means for moving the clamping jaws so as decrease the gap therebetween and to apply a clamping force to the booklet.

The stop plate can thereby be made unnecessary and the speed and ease of operation improved.

Advantageously, a reciprocable blade provides the folding and inserting means and is movable into and out of the gap, the blade, during its stroke of movement into the gap, contacting a stack of sheets to fold the sheets about its leading edge to form the booklet, and at the end of the said stroke, determining the said position of the booklet relative to the jaws.

Advantageously, the blade has a longitudinal groove in its lower edge.

Preferably, the apparatus includes sheet-feeding means for feeding a stack of sheets into a position to be contacted by the blade during its stroke of its movement into the gap.

Advantageously, the sheet-feeding means are arranged to feed the stack of sheets into the said position in a direction substantially perpendicular to the direction of insertion.

In one type of apparatus, in the final position of the stack of sheets, the spinal portion lies between the jaws and the clamping force has the effect of reshaping the spinal portion of the booklet.

This is particularly suited to booklets having relatively few sheets, for example 10 or fewer, or booklets of any number of sheets having loop staples.

In another type of apparatus, in the final position of the stack of sheets, the spinal portion protrudes from the jaws by a predetermined distance in the direction of insertion, the apparatus including a forming means which is displaceable in the longitudinal direction of the spinal portion to exert pressure against the curved end surface portion and thereby produce a flattening of the curved end surface.

The forming means conveniently comprises a roller.

The forming means may be arranged to make a single pass along the length of the spinal portion, or may be arranged to make a plurality of passes along the length of the spinal portion.

Advantageously, the final position of the stack of sheets is adjustable.

Usually the clamping jaws will be movable simultaneously and symmetrically about the mid-point of the gap therebetween.

Advantageously, the face of each jaw which contacts the stack of sheets is a surface of a resiliently-deformable material.

The material is preferably a synthetic rubber material which preferably has a Shore A hardness of from 50 to 90, more preferably from 70 to 80.

Conveniently, the face of each jaw which contacts the stack of sheets is a surface of an insert received in a recess in the respective jaw.

Advantageously, the inserts protrude into the gap to form a narrower gap portion closer to the insertion means and a wider gap portion further therefrom.

The apparatus may include a rotatable guide roller adjacent each clamping jaw and positioned to guide the sheets into the gap between the jaws during insertion.

The rollers are preferably restrained against rotation in the direction opposite to that in which they are rotated by the sheets during insertion.

The invention also provides an apparatus for treating a stack of sheets of sheet material, comprising first and second clamping jaws which define a gap therebetween and are movable relative to each other to increase and decrease the gap, means for inserting into the gap a stack of sheets of sheet material folded about an axis to form a booklet having a spinal portion, and means for moving the clamping jaws so as to decrease the gap therebetween and to apply a clamping force to the booklet, the face of each jaw which contacts the stack of sheets being a surface of a resiliently-deformable material.

The invention also provides a method of treating a stack of sheets of sheet material, comprising providing a stack of sheets of sheet material, folding the stack of sheets about an axis to form a booklet having a spinal portion, the spinal portion having a convex end surface which extends in the direction of the axis, inserting the folded stack of sheets into a gap defined between first and second clamping jaws into a predetermined position in which the spinal portion lies between the jaws, and moving the clamping jaws towards each other in order to apply a force to reshape the spinal portion of the booklet.

Further, the invention provides a method of treating a stack of sheets of sheet material, comprising providing a stack of sheets of sheet material, folding the stack of sheets about an axis to form a booklet having a spinal portion, the spinal portion having a convex end surface which extends in the direction of the axis, inserting the folded stack of sheets by means of an insertion member into a gap defined between first and second clamping jaws into a final position determined by the insertion member, moving the jaws towards each other to apply a clamping force to the booklet, the spinal portion thereafter protruding from the jaws in the direction of insertion, and passing a forming means in the longitudinal direction of the spinal portion to exert pressure against the curved end surface and thereby produce a flattening of the curved end surface.

BRIEF DESCRIPTION OF THE DRAWINGS

Embodiments of the invention will now be described by way of example and with reference to the schematic drawings of this specification, in which.

DETAILED DESCRIPTION OF ILLUSTRATIVE EMBODIMENTS

Figure 1:
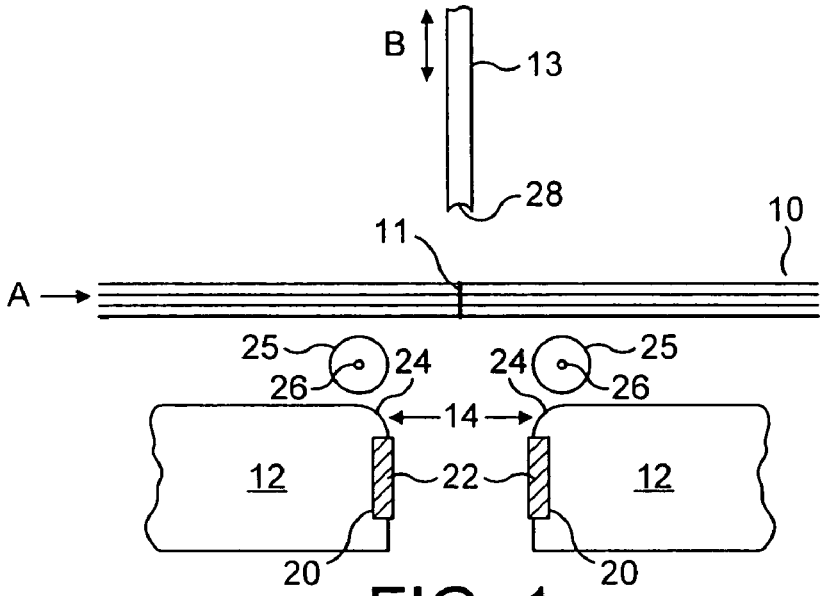
FIG. 1 shows a stack of sheets prior to insertion and folding into the clamping jaws in a first mode of operation.

The apparatus shown in the drawings is shown only schematically, to illustrate the sequence of movements involved in carrying out these modes of operation of the invention.

The first mode of operation is first described.

As shown in FIG. 1, a stack 10 consisting of a plurality of sheets of paper or other material is stitched or stapled at one or more positions along an axis 11 to hold the sheets together and maintain them in register. The number of sheets in the stack is shown only schematically: the actual number would typically be from 10 to 60. The stack 10 is fed in the direction of arrow A by a feed mechanism (not shown) into a position above a pair of open clamping jaws 12. In an alternative arrangement, the stack of sheets is fed in the same plane but in a direction orthogonal to that of arrow A. The clamping jaws 12 are elongate bars which extend the length of the set of sheets 10 (i.e. perpendicularly to the plane of the drawing sheet: FIG. 1 shows an end view only). The jaws 12 are movable towards and away from each other so that a gap 14 defined between the jaws becomes correspondingly smaller and larger.

Each jaw 12 has in its end face a rectangular-section recess 20 which receives an insert 22 which is made from a resiliently deformable silicone rubber material having a Shore A hardness of about 70 to 80. It has been found that a material of this hardness does not damage the staples or stitches of a stapled or stitched stack of sheets during subsequent processing. It is believed that materials of Shore A hardnesses in the range of from about 50 to about 90 are also suitable.

The nature of the material of the inserts 22 and its Shore A hardness is chosen in accordance with various factors which include: the need to be hard enough to grip the sheets of paper as described below; the need to be sufficiently soft to prevent the staples or stitches of stapled or stitched stacks of paper cutting into the sheets of the stack; and the need to be sufficiently resiliently deformable in compression to function as described below.

The upper edges of the jaws 12 are chamfered as indicated at 24 to facilitate insertion of the stack of sheets therebetween. A roller 25 mounted for rotation on an axle 26 is positioned above each jaw. The function of the rollers 25 will be described later.

A reciprocable blade 13 is positioned above the mid-point of the gap 14 and is movable up and down in the direction of the arrow B. The blade 13 has a longitudinal groove 28 in its lower edge. The function of this will be described later. In the position shown in FIG. 1, the axis 11 of stitching or stapling is aligned with the mid-point of the gap 14 and with the centreline of the blade 13. On the downward stroke of its movement, the blade 13 forces the stack of sheets down between the jaws 12, thereby folding the sheets about the axis 11 and forming a booklet. During this downward movement of the blade 13, the groove 28 receives the staples or stitches of the stack of sheets. This assists in location of the blade on the stack 10 and in centralisation of the stack in the gap 14. The groove 28 also prevents damage to the staples or stitches. The rollers 25 further assist in guiding the stack of sheets into the gap 14. The end point of the downward stroke of movement of the blade 13 determines the final position of the folded stack of sheets relative to the jaws 12. This position is adjustable by adjustment of the stroke of the blade 13. There is no stop plate or other means against which the folded stack rests in its final position.

If desired, the rollers 25 can be mounted on their respective axles 26 in such a way that the roller shown on the left in the drawings is rotatable in the clockwise direction only and the other roller in the other direction only. The rollers 25 thus function as a one-way clutch which allows insertion of the stack of sheets but resists its retraction.

Figure 2:
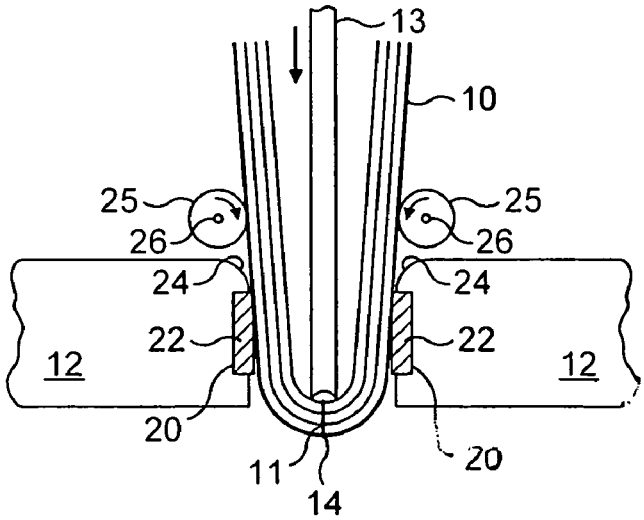
FIG. 2 shows the sheets of FIG. 1 after folding and insertion into the clamping jaws shown in FIG. 1.
Figure 3:
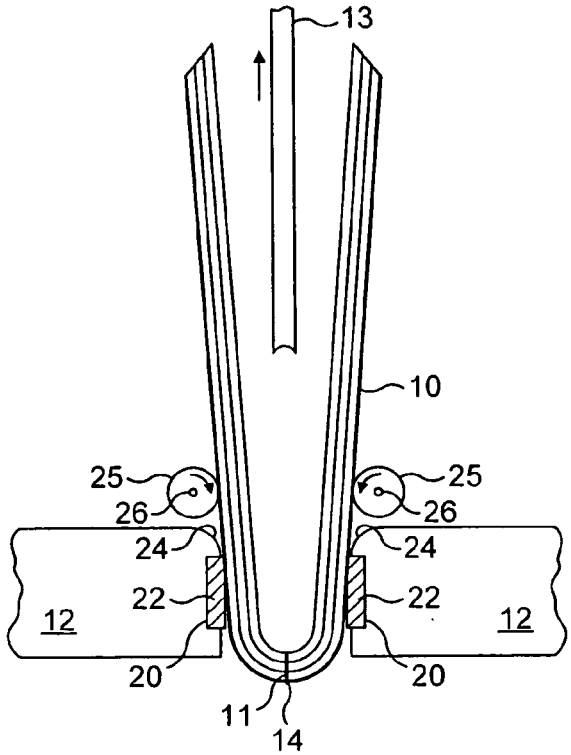
FIG. 3 shows the sheets folded and inserted into the clamping jaws and the insertion blade in its retracted position.

When the blade 13 has reached the end point of its downward stroke as shown in FIG. 2, the stack of sheets is shaped as shown in that figure. The shape, in the view shown in FIG. 2, is that of a "U" but with its arms somewhat divergent. From this position, the blade 13 begins its upward stroke, during which the folded stack of sheets remains in its position shown in FIG. 2 relative to the jaws 12 determined by the lower limit position of the blade 13. The outward flaring of the sheets, the surface friction between the sheets and the rubber inserts 22 and the one-way clutch function of the rollers 25 which resist upward movement of the sheets together with the blade 13, all contribute the sheets being held in this position. Thus, as the blade 13 is withdrawn from between the folded sheets, the sheets remain in a position relative to the jaws 12 defined by the end point of the downward stroke of the blade 13. The jaws remain in their open position throughout this procedure. FIG. 3 shows the blade 13 and the upper end-point of its movement, in which it lies between the folded sheets but is well clear of the jaws 12 and rollers 25.

It will be noted that the lower end-point of the movement of the blade 13 is chosen such that, in the position of the folded sheets shown in FIG. 3, the lowermost part of the stack of sheets protrudes below the lower edges of the jaws 12. This is not necessarily the case however and, in this final position of the sheets, determined by the blade 13, the lowermost part of the stack may be aligned with the lower edges of the jaws 12 or may even lie above their lower edges.

Figure 4:
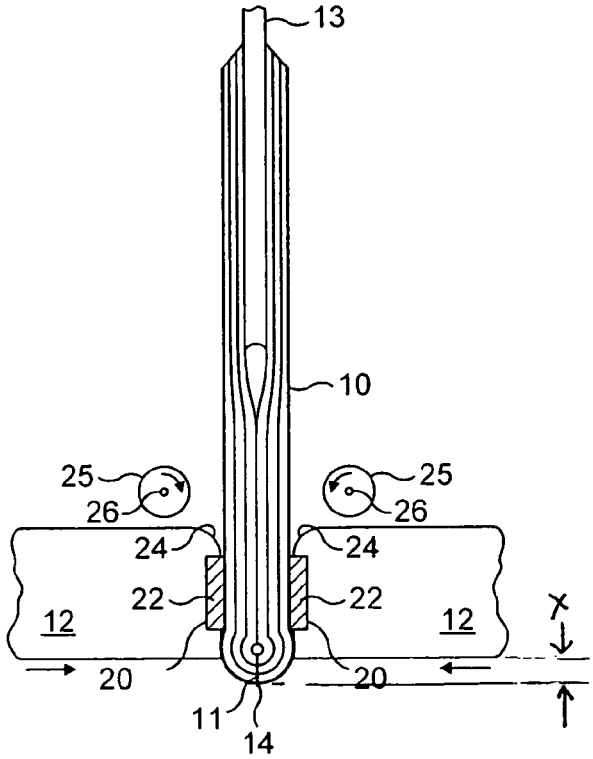
FIG. 4 shows the deformation of the folded sheets produced by moving together of the clamping jaws.

From the position shown in FIG. 3, the jaws 12 are now moved towards each other until a relatively high clamping force—(about 100 lbf or 450 N) is exerted on the folded sheets. This movement of the jaws brings about a deformation of the folded stack of sheets in the region adjacent the fold. The result of this is shown in FIG. 4 which shows the situation after the jaws 12 have been moved to their inner limit positions. It is important that the stack of sheets 10 is firmly gripped by the clamping jaws to prevent any relative movement of the sheets during this movement of the jaws. The end surface 14 of the protruding portion of the stack of sheets is still convex in shape at this stage.

It will be noted that, in the condition shown in FIG. 4, the lowermost edge of the stack of sheets protrudes below the lowermost edges of the jaws by a distance which is shown as "x" in FIG. 4. Whilst the initial position of the lower edge of the folded sheets determined by the lower end-point of the downward stroke of the blade 13 may be above, aligned with or below the lower edges of the jaws 12, it is important that, after the inward movement of the jaws, the lowermost edge of the stack protrudes below the lower edges of the jaws by the distance "x".

The amount of protrusion x will vary depending inter alia on the number of sheets and the material of which they are composed. The sheets will normally be a paper material but the thickness, surface finish, etc. will vary and adjustment will need to be made to allow for this. A cover sheet of a different material may also have an effect. It has been found that a protrusion x of from 0.5 mm to 1.75 mm produces optimum results under most circumstances, but it should be understood that these figures are preferred figures only and do not limit the scope of the invention.

Figure 5:
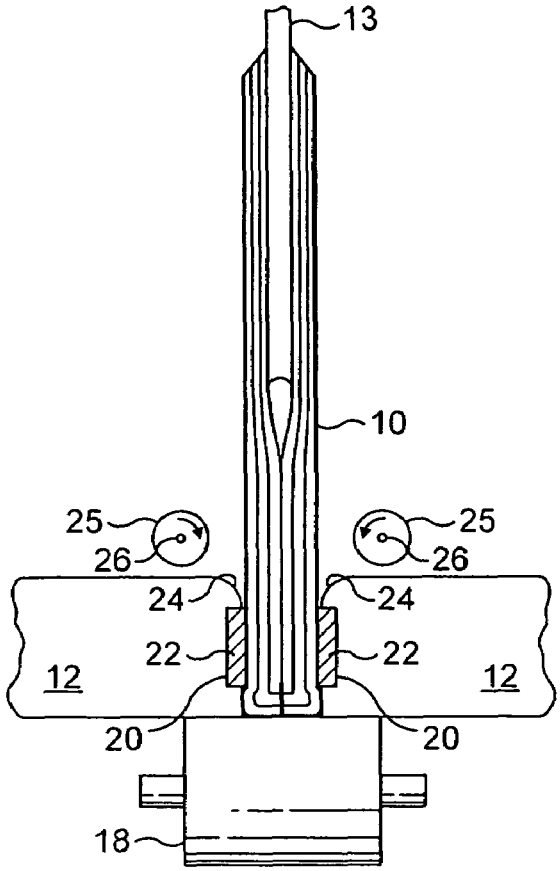
FIG. 5 shows the passage of a roller to deform the spine of the booklet shown in FIG. 4.
Figure 6:
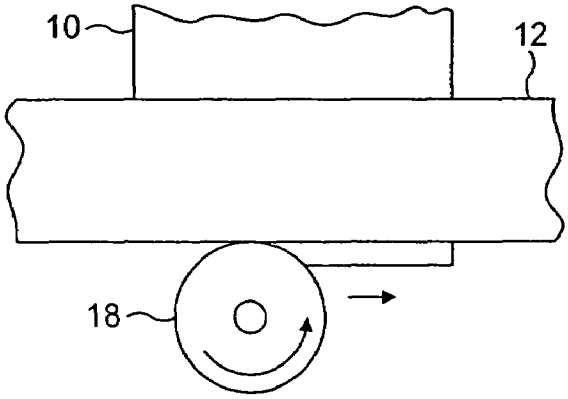
FIG. 6 is a side view of the parts shown in FIG. 5 showing the passage of the roller along the spine.

Once the booklet of sheets has been firmly gripped by the clamping jaws 12, a forming roller 18 is arranged to travel the length of the clamping jaws, below the jaws, thereby compressing and deforming the convex spine of the sheets into a flattened shape, in which the convex spine is deformed into the space formed beneath the inserts 22, above the roller 18 and between the jaws 12. This is shown in FIGS. 5 and 6. In its passage beneath the clamping jaws 12 the forming roller 18 is almost in contact with the jaws. This is an important feature in producing the required effect. The roller 18 thus exerts a substantial upward pressure against the spine of the folded sheets in its passage along the length of the jaws. Depending for example upon the number of sheets and the materials used, the roller 18 may make a single pass or more than one pass along the length of the spine in order to create the desired flattening of the spine.

Figure 7:
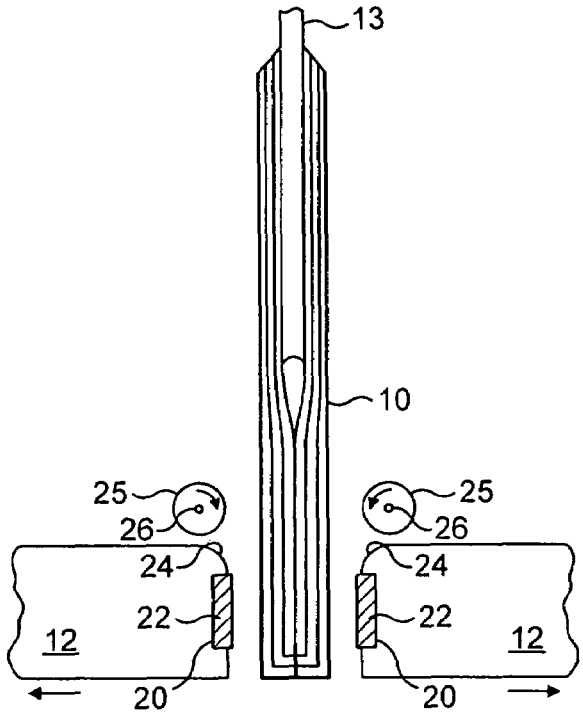
FIG. 7 shows the booklet after passage of the roller and opening of the jaws.
Figure 8:
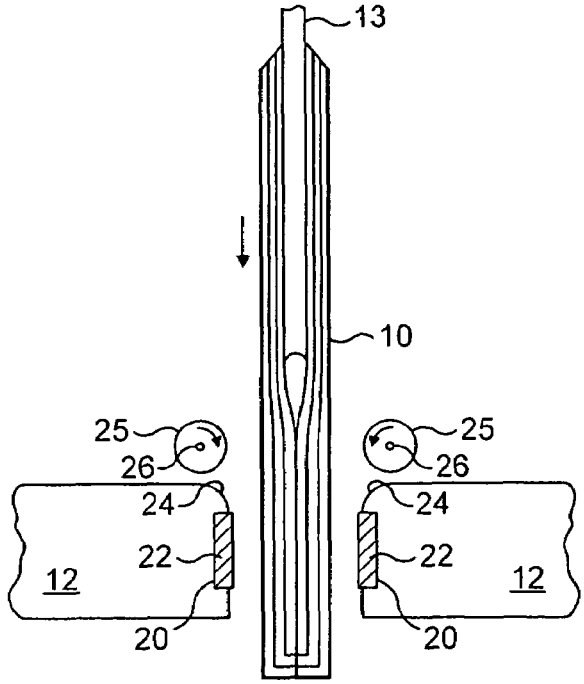
FIG. 8 shows the removal of the booklet from the apparatus.

When the roller 18 has performed its function it is returned to its inactive position at one end of the jaws and the jaws 12 are opened as shown in FIG. 7 to permit the booklet thus formed to be ejected by a further downward movement of the blade 13 in the direction of arrow B, as shown in FIG. 8.

FIGS. 7 and 8 show the booklet after treatment as shown in FIGS. 4 to 6. It will be seen from FIGS. 7 and 8 that the booklet when released from the jaws has a flattened spine and a "square back" shape. The free edges of the sheets of the finished booklet can be trimmed if necessary.

By flattening the spine of the booklet in this way, the outer faces of the booklet have no appreciable bowing adjacent the spine, hence facilitating subsequent storage and transportation of the booklets, which stack easily on one another.

A second mode of operation more suited to booklets having relatively few sheets, for example fewer than 10, will now be described with reference to FIGS. 9 to 14 of the drawings, in which parts corresponding to FIGS. 1 to 5 are indicated by primed reference numerals.

It will be noted that the apparatus shown in FIGS. 9 to 14 lacks the forming roller which is shown in FIGS. 5 and 6.

In the second mode of operation, the stack 10' of sheets is inserted between the jaws 12' to a depth which is generally less than the depth in the first mode of operation. Again, feeding of the stack 10' can be in the direction of arrow A, or orthogonal thereto. The depth is again determined by the end-point of the downward stroke of the movement of the blade 13'. The end-point can be determined by adjustment of the blade 13' and is chosen such that, in the final position of the folded stack of sheets, the lowermost edge of the curved spinal portion of the sheets lies no lower than the lowermost edge of the inserts 22'. The lowermost edge of the curved spinal portion therefore lies above the lowermost edges of the jaws 12' by a distance "y" shown in FIG. 10.

The depth of insertion is controlled by the movement of the blade 13. There is again no stop plate.

Figure 9:
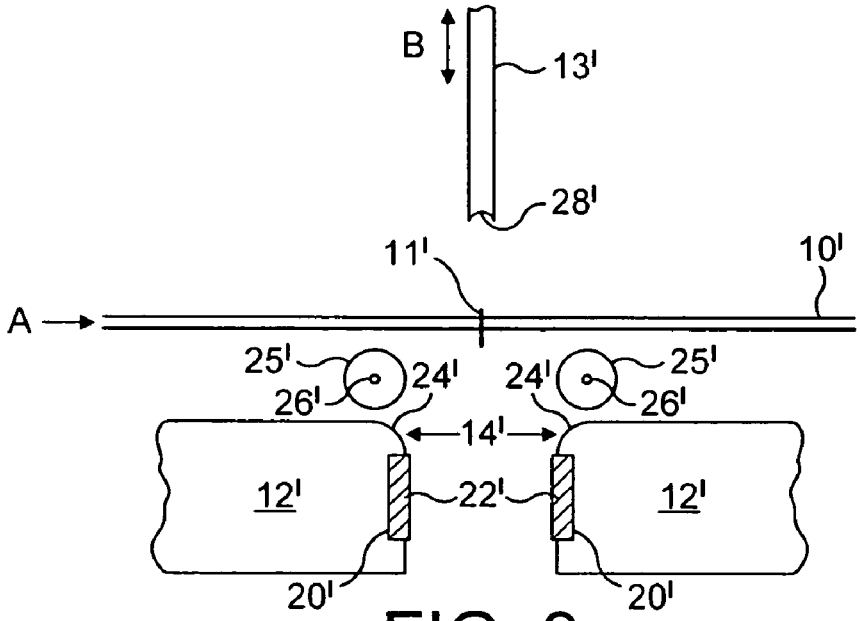
FIGS. 9 to 12 correspond to FIG. 1 to 4 respectively but show a second mode of operation.
Figure 10:
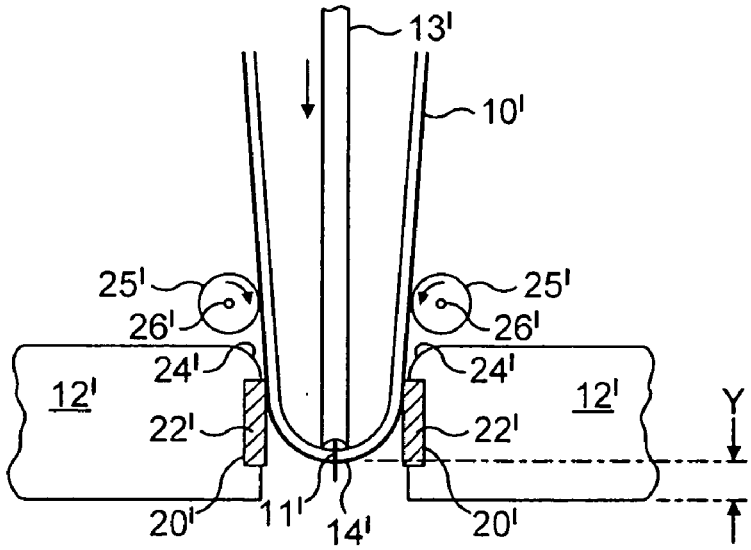
Figure 11:
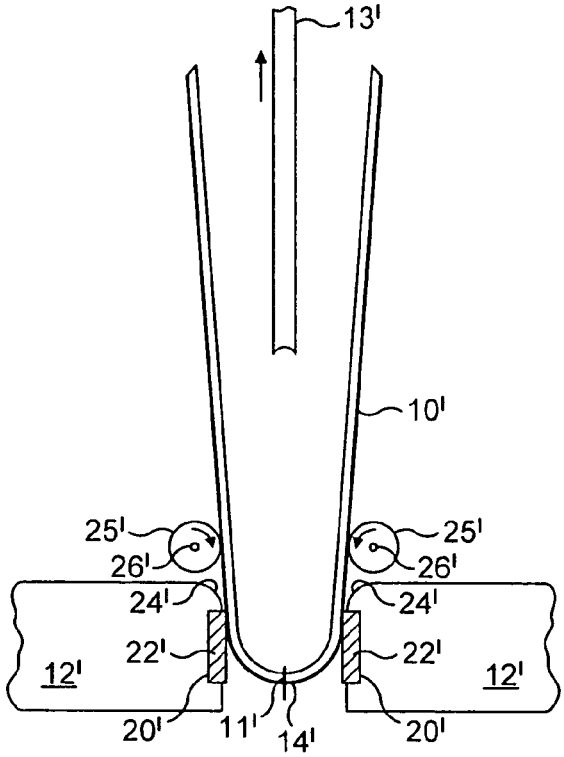

FIGS. 9 to 11 of the drawings show the initial sequence of operations and correspond to FIGS. 1 to 3 for the first mode of operation.

Figure 12:
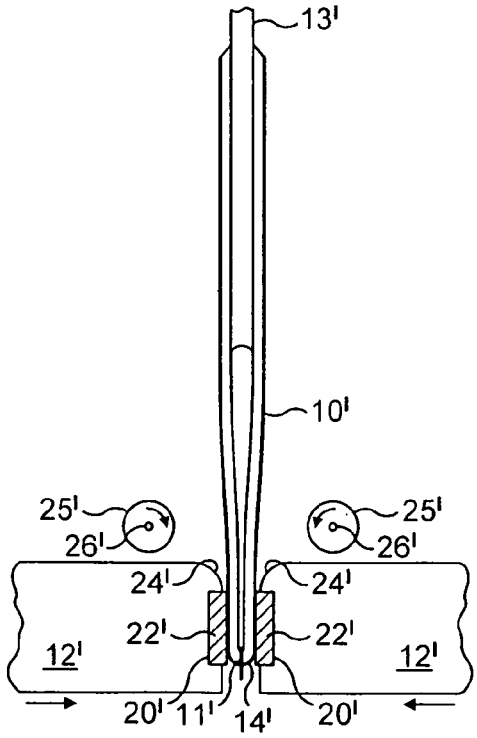

FIG. 12 shows the condition of the sheets folded to form a booklet after the clamping force has been applied by the jaws 12'. It will be seen that, for the initial position of the stack shown in FIG. 10, the lowermost edge of the spinal portion is aligned with the lower edges of the inserts 22' in the recesses 20' in the jaws 12'.

The second mode of operation differs from the first in that no forming roller is used to deform and flatten the spine of the booklet, as can be seen from FIG. 12. Instead, the booklet is simply subjected to a clamping force (again about 100 lbf or 450 N) and the resulting deformation between the jaws produces a reshaping of the spinal portion and a final booklet having much reduced outward bowing of the sheets. Although the end surface of the spinal portion retains its convex shape the faces of the final booklet are much flatter adjacent the spine and the booklets can again be easily stacked one on another, with their spines all at the same side.

Figure 13:
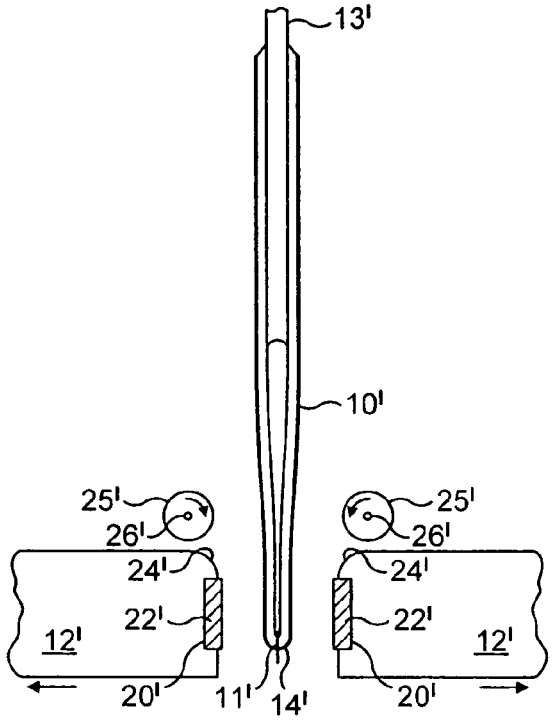
FIGS. 13 and 14 correspond to FIGS. 7 and 8 respectively but show the second mode of operation.
Figure 14:
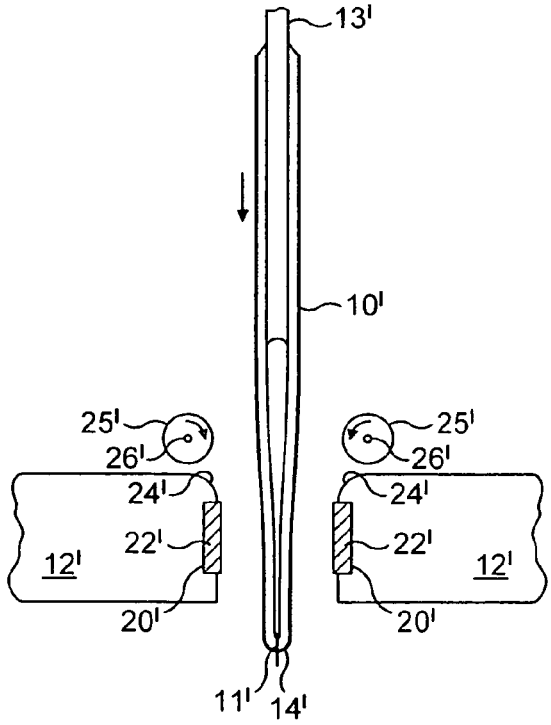

FIGS. 13 and 14 show the final stages of the second mode of operation. These correspond to FIGS. 7 and 8 and show the opening of the jaws 12' and ejection of the booklet by downward movement of the blade 13'. The free edges of the sheets of the finished booklet can be trimmed if necessary.

The absence of the stop plate makes the present invention suitable for use on booklets which are secured together by loop staples. This is the case regardless of the number of sheets in such booklets.

As already mentioned, by reshaping the spine of the booklet made, the resulting product will lie flat without appreciable outward bowing of the sheets adjacent the spine, hence facilitating subsequent storage and transportation of the booklets.

Although reference has been made above to the set of sheets 10 being stitched or stapled together before insertion into the forming apparatus, the invention can also be carried out in either mode without the sheets being stitched. In the latter case, the set of sheets can be simply folded or one could use an adhesive, for example a pressure sensitive adhesive, which will secure the sheets together under the pressure which is generated. That would require the application of the adhesive to the sheets before the folded set of sheets is inserted between the clamping jaws.

Although not shown in the drawings, and not described in detail above, the sequence of steps which make up both modes of operation in accordance with the invention can be controlled by an operator or can be part of an automated system after the apparatus has been set up for a particular production run.

Whilst the invention has been illustrated and described in detail in the drawings and foregoing description, the illustration and description are not to be considered as restrictive in character, it being understood that only the preferred embodiments have been shown and described and that all changes and modifications that come within the spirit of the invention are desired to be protected.

What is claimed:

1. An apparatus for treating a stack of sheets of sheet material, comprising first and second clamping jaws which define a gap therebetween and are movable relative to each other to increase and decrease the gap, means for folding a stack of sheets of sheet material about an axis to form a booklet having a spinal portion, the spinal portion having a convex end surface which extends in the direction of the axis, and means for inserting the booklet into the gap into a final position determined by the inserting means without the end surface contacting a stop located beyond the clamping jaws in the direction of insertion, in which the spinal portion lies between the jaws or protrudes therefrom by a predetermined distance in the direction of insertion, and means for moving the clamping jaws so as to decrease the gap therebetween and to apply a clamping force to the booklet.

2. An apparatus according to claim 1, in which a reciprocable blade provides the folding and inserting means and is movable into and out of the gap, the blade, during its stroke of movement into the gap, contacting a stack of sheets to fold the sheets about its leading edge to form the booklet and, at the end of the said stroke, determining the said position of the booklet relative to the jaws.

3. An apparatus according to claim 2, in which the blade has a longitudinal groove in its lower edge.

4. An apparatus according to claim 3, in which the material is a synthetic rubber material.

5. An apparatus according to claim 2, including sheet-feeding means for feeding a stack of sheets into a position to be contacted by the blade during its stroke of its movement into the gap.

6. An apparatus according to claim 5, in which the sheet-feeding means are arranged to feed the stack of sheets into the said position in a direction substantially perpendicular to the direction of insertion.

7. An apparatus according to claim 1, in which, in the final position of the stack of sheets, the spinal portion protrudes from the jaws in the direction of insertion, the apparatus including a forming means which is displaceable in the longitudinal direction of the spinal portion to exert pressure against the convex end surface of the spinal portion and thereby produce a flattening of the convex end surface.

8. An apparatus according to claim 7, in which the forming means comprises a roller.

9. An apparatus according to claim 7, in which the forming means is arranged to make a single pass along the length of the spinal portion.

10. An apparatus according to claim 7, in which the forming means is arranged to make one or more passes along the length of the spinal portion.

11. An apparatus according to claim 1, in which the final position of the stack of sheets is adjustable.

12. An apparatus according to claim 1, in which the clamping jaws are movable simultaneously and symmetrically about the mid-point of the gap therebetween.

13. An apparatus according to claim 1, in which the face of each jaw which contacts the stack of sheets is a surface of a resiliently-deformable material.

14. An apparatus according to claim 13, in which the material has a Shore A hardness of from 50 to 90.

15. An apparatus according to claim 13, in which the material has a Shore A hardness of from 70 to 80.

16. An apparatus according to claim 1, in which, in the final position of the stack of sheets, the convex end surface of the spinal portion lies between the jaws and the clamping force has the effect of reshaping the spinal portion of the booklet.

17. An apparatus according to claim 1, in which the face of each jaw which contacts the stack of sheets is a surface of an insert received in a recess in the respective jaw.

18. An apparatus according to claim 17, in which the inserts protrude into the gap to form a narrower gap portion closer to the insertion means and a wider gap portion further therefrom.

19. An apparatus for treating a stack of sheets of sheet material, comprising first and second clamping jaws which define a gap therebetween and are movable relative to each other to increase and decrease the gap, means for folding a stack of sheets of sheet material about an axis to form a booklet having a spinal portion, the spinal portion having a convex end surface which extends in the direction of the axis, and means for inserting the booklet into the gap into a final position determined by the inserting means, in which the spinal portion lies between the jaws or protrudes therefrom by a predetermined distance in the direction of insertion, and means for moving the clamping jaws so as to decrease the gap therebetween and to apply a clamping force to the booklet, and a rotatable guide roller adjacent each clamping jaw and positioned to guide the sheets into the gap between the jaws during insertion.

20. An apparatus according to claim 19, in which the rollers are restrained against rotation in the direction opposite to that in which they are rotated by the sheets during insertion.

21. An apparatus for treating a stack of sheets of sheet material, comprising first and second clamping jaws which define a gap therebetween and are movable relative to each other to increase and decrease the gap, means for inserting into the gap a stack of sheets of sheet material folded about an axis to form a booklet having a spinal portion, and means for moving the clamping jaws so as to decrease the gap therebetween and to apply a clamping force to the booklet, the face of each jaw which contacts the stack of sheets being a surface of a resiliently-deformable material, wherein the spinal portion does not contact a stop located beyond the clamping jaws in the direction of insertion.

22. A method according to claim 21, in which the material is a synthetic rubber material.

23. A method according to claim 21, in which the material has a Shore A hardness of from 50 to 90.

24. A method according to claim 21, in which the material has a Shore A hardness of from 70 to 80.

25. A method of treating a stack of sheets of sheet material, comprising providing a stack of sheets of sheet material, folding the stack of sheets about an axis to form a booklet having a spinal portion, the spinal portion having a convex end surface which extends in the direction of the axis, inserting the folded stack of sheets into a gap defined between first and second clamping jaws into a predetermined position in which the convex end surface of the spinal portion lies between the jaws, and moving the clamping jaws towards each other in order to apply a force to reshape the spinal portion of the booklet.

26. A method according to claim 25, in which the face of each jaw which contacts the stack of sheets is a surface of a resiliently deformable material.

27. A method according to claim 26, in which the material is a synthetic rubber material.

28. A method according to claim 26, in which the material has a Shore A hardness of from 50 to 90.

29. A method according to claim 26, in which the material has a Shore A hardness of from 70 to 80.

30. A method of treating a stack of sheets of sheet material, comprising providing a stack of sheets of sheet material, folding the stack of sheets about an axis to form a booklet having a spinal portion, the spinal portion having a convex end surface which extends in the direction of the axis, inserting the folded stack of sheets by means of an insertion member into a gap defined between first and second clamping jaws into a final position determined by the insertion member without the end surface contacting a stop located beyond the clamping jaws in the direction of insertion, moving the jaws towards each other to apply a clamping force to the booklet, the spinal position thereafter protruding from the jaws in the direction of insertion, and passing a forming means in the longitudinal direction of the spinal portion to exert pressure against the convex end surface of the spinal portion and thereby produce a flattening of the convex end surface.

31. A method according to claim 30, including passing the forming means a single time along the length of the spinal portion.

32. A method according to claim 30, including passing the forming means one or more times along the length of the spinal portion.

33. A method of treating a stack of sheets of sheet material, comprising providing a stack of sheets of sheet material, folding the stack of sheets about an axis to form a booklet having a spinal portion, the spinal portion having a convex end surface which extends in the direction of the axis inserting the folded stack of sheets by means of an insertion means into a gap defined between first and second clamping jaws into a final position determined by the insertion means without the end surface contacting a stop located beyond the clamping jaws in the direction of insertion, and moving the jaws towards each other to apply a clamping force to the booklet.

34. A method according to claim 33, in which the folding and inserting steps are carried out by a reciprocable blade which is movable into and out of the gap, the blade, during its stroke of movement into the gap, contacting a stack of sheets to fold the sheets about its leading edge to form the booklet and, at the end of the said stroke, determining the said position of the booklet relative to the jaws.

35. A method according to claim 33, in which, in the final position of the stack of sheets, the spinal portion lies between the jaws and the clamping force has the effect of reshaping the spinal portion of the booklet.

36. A method according to claim 33, in which, in the final position of the stack of sheets, the spinal portion protrudes from the jaws in the direction of insertion, the method including passing a forming means in the longitudinal direction of the spinal portion to exert pressure against the convex end surface of the spinal portion and thereby produce a flattening of the convex end surface.

37. A method according to claim 36, including passing the forming means a single time along the length of the spinal portion.

38. A method according to claim 36, including passing the forming means a plurality of times along the length of the spinal portion.

39. A method according to claim 33, in which the clamping jaws are moved simultaneously and symmetrically about the mid-point of the gap therebetween.

* * * * *